US005482439A

United States Patent [19]

Chen

[11] Patent Number: 5,482,439

[45] Date of Patent: Jan. 9, 1996

[54] POWER BREAKER FOR A COMPRESSOR FOR AUTOMOBILES WITH A CURVED PLUG AND WRINKLED CONTROL DISK

[76] Inventor: Chi-Wen Chen, P.O. Box 82-144, Taipei, Taiwan

[21] Appl. No.: 370,413

[22] Filed: Jan. 9, 1995

[51] Int. Cl.[6] ..... F04B 49/06

[52] U.S. Cl. ..... 417/44.8; 200/83 J

[58] Field of Search ..... 417/44.9, 44.8; 200/83 R, 83 B, 83 J, 83 P

[56] References Cited

U.S. PATENT DOCUMENTS

| | | | |
|---|---|---|---|
| 3,054,871 | 9/1962 | Skay | 200/83 B |
| 3,581,034 | 5/1971 | Schupp | 200/83 B |
| 3,584,168 | 6/1971 | Halpert | 200/83 R |
| 3,738,776 | 6/1973 | Debare | 417/44.9 |
| 3,816,685 | 6/1974 | Fiore | 200/83 P |
| 4,296,287 | 10/1981 | Boulanger et al. | 200/83 P |
| 4,644,116 | 2/1987 | Miyakawa | 200/83 J |
| 4,667,069 | 5/1987 | Cholkeri | 200/83 B |
| 4,867,645 | 9/1989 | Foster | 200/83 J |
| 5,267,363 | 12/1993 | Chaffee | 417/44.9 |
| 5,373,127 | 12/1994 | Homol | 200/83 J |

FOREIGN PATENT DOCUMENTS

| | | | |
|---|---|---|---|
| 528480 | 11/1921 | France | 417/44.8 |
| 554550 | 6/1923 | France | 417/44.9 |

*Primary Examiner*—Richard A. Bertsch
*Assistant Examiner*—Ted Kim
*Attorney, Agent, or Firm*—Alfred Lei

[57] ABSTRACT

A power breaker for a compressor for automobiles including a base provided with a first conducting member and a second conducting member, a circular plate disposed within the base and having a center hole, a resilient disc arranged on the circular plate and including annular portion on which is fitted a diaphragm, a pin inserted through the center hole of the circular plate and having one end bearing against the diaphragm of the resilient disc and another end against the first conducting member, a control disc arranged on the resilient disc, a sealing ring disposed on the control disc, a plug formed with a cavity at one end and a curved recess at another end, a spring mounted in the cavity of the plug, a cover engaged with a top of the base and having a threaded hole, and an adjusting screw threaded engaged with the threaded hole of the cover.

1 Claim, 6 Drawing Sheets

POWER BREAKER FOR A COMPRESSOR FOR AUTOMOBILES WITH A CURVED PLUG AND WRINKLED CONTROL DISK

CROSS-REFERENCE

This is an improvement of the U.S. Patent application Ser. No. 127,015, granted U.S. Pat. No. 5,352,096 an owned by the same inventor.

BACKGROUND OF THE INVENTION

U.S. Pat. No. 5,352,096 discloses an air compressor A1 for automobiles which is fixedly mounted on a cylinder by a connector A2. The connector A2, a diaphragm A4, a main body A5 and two conducting members A6 are fixedly kept in place by a ring member A3. Within the cylinder is mounted a piston A7 which receives a spring A8 and has a protuberance on which is fitted a circular conductor A10. The position of the spring A8 is regulated by an adjusting rod A9.

However, the diaphragm A4 will lose its resiliency under a high pressure. Therefore, it is an object of the present invention to provide an improvement in the structure of a power breaker for a compressor for automobiles which can obviate and mitigate the above-mentioned drawbacks.

SUMMARY OF THE INVENTION

This invention relates to an improvement in the structure of a power breaker breaker for a compressor for automobiles.

It is the primary object of the present invention to provide an improvement in the structure of a power breaker for a compressor for automobiles which is compact in size.

It is another object of the present invention to provide an improvement in the structure of a power breaker for a compressor for automobiles which is simple in construction.

It is still another object of the present invention to provide an improvement in the structure of a power breaker for a compressor for automobiles which is low in cost.

It is still another object of the present invention to provide an improvement in the structure of a power breaker for a compressor for automobiles which is durable in use.

It is a further object of the present invention to provide an improvement in the structure of a power breaker for a compressor for automobiles which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
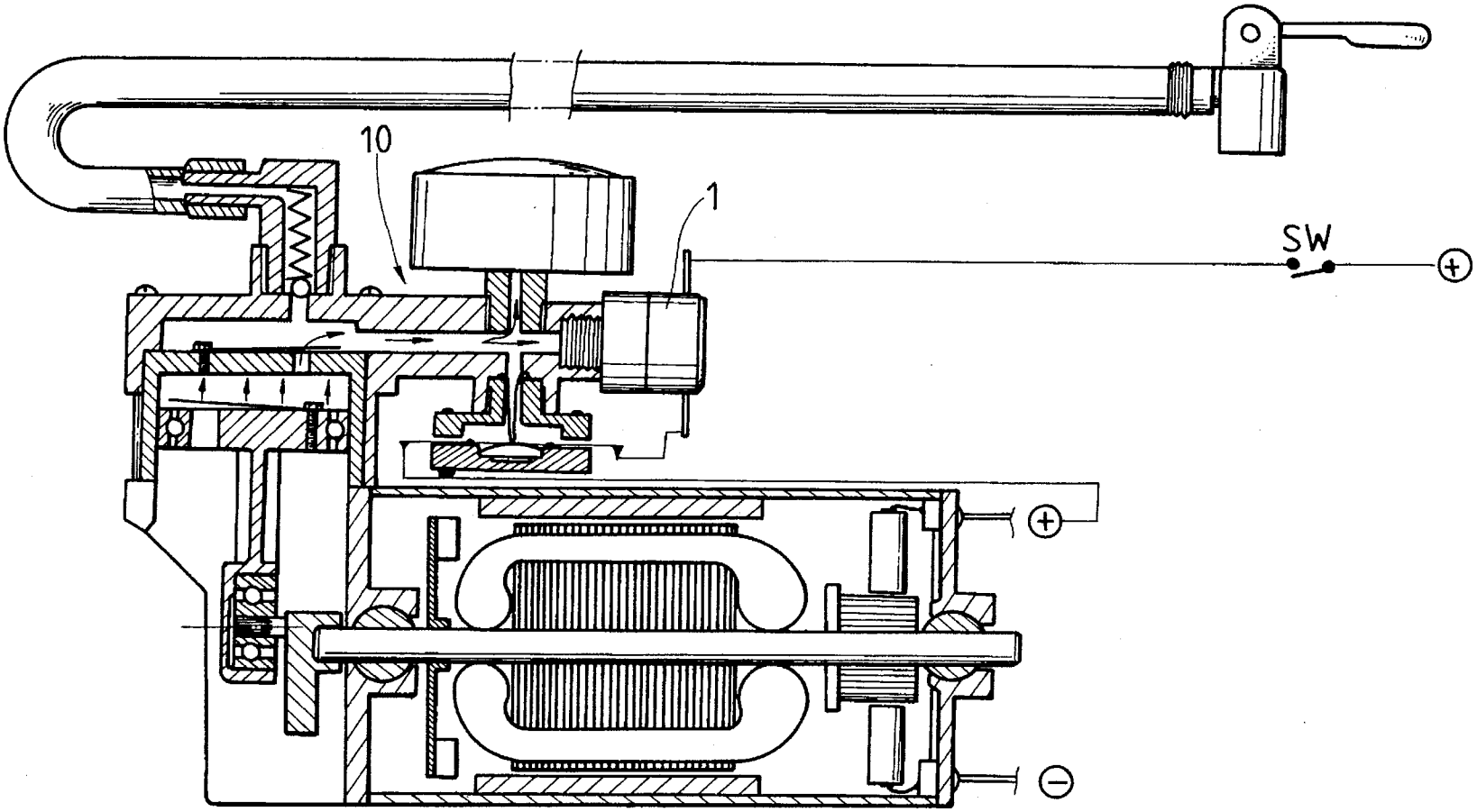
FIG. 1 is a sectional view of an air compressor equipped with a power breaker according to the present invention.
Figure 2:
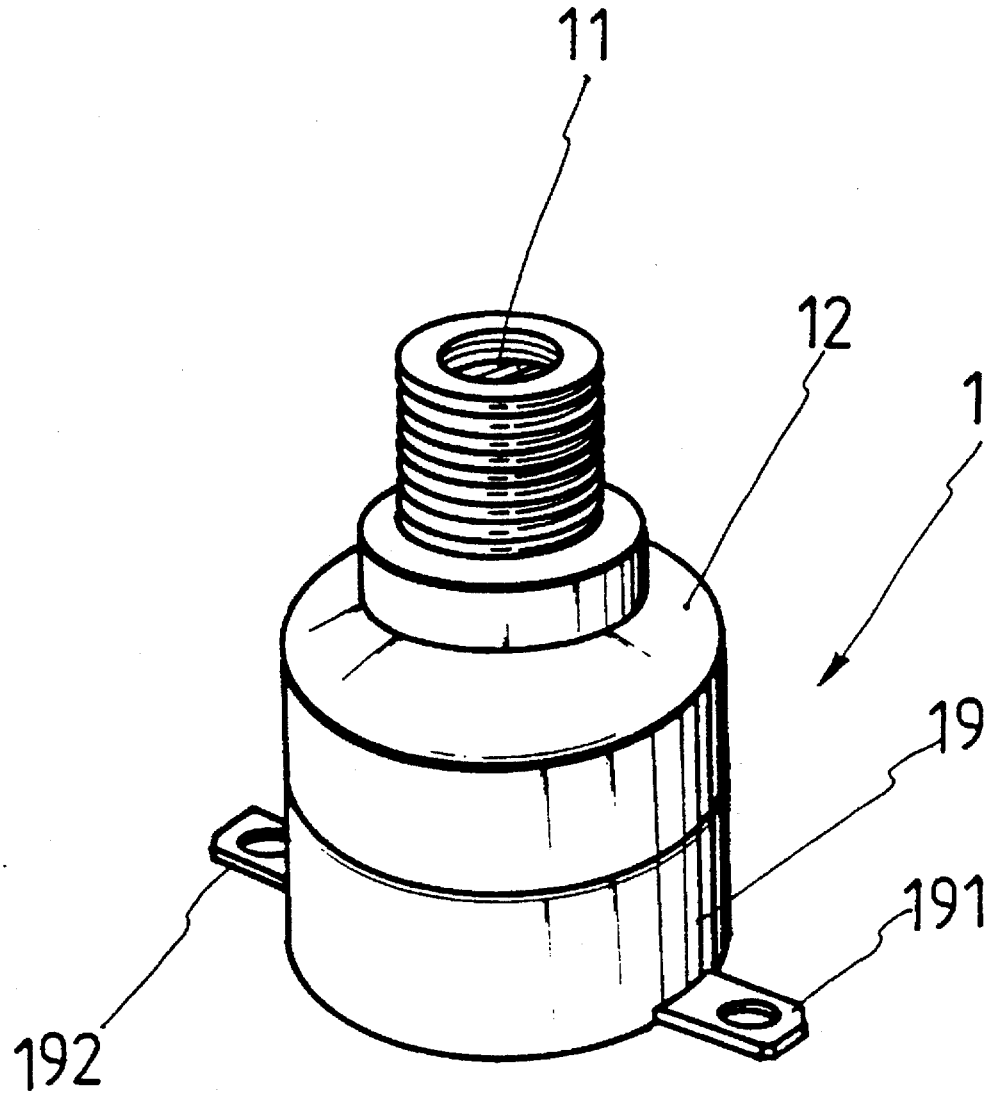
FIG. 2 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the power breaker for a compressor for automobiles according to the present invention mainly comprises an adjusting screw 11, a cover 12, a spring 13, a plug 14, a sealing ring 15, a control disc 2, a resilient disc 16, a circular plate 17, a pin 18, and a base 19.

The adjusting screw 11 is formed with a center hole 111 and external threads 112.

The cover 12 has a threaded hole 121 adapted to the external threads 112 of the adjusting screw 11.

The plug 14 is formed with a cavity 141 at one end and a curved recess 142 at the other end. The plug 14 is arranged into the housing 12.

The spring 13 is fitted between the adjusting screw 11 and the plug 14 and has its one end received in the cavity 141 of the plug 14.

The sealing ring 15 is arranged within the cover 12.

Figure 3:
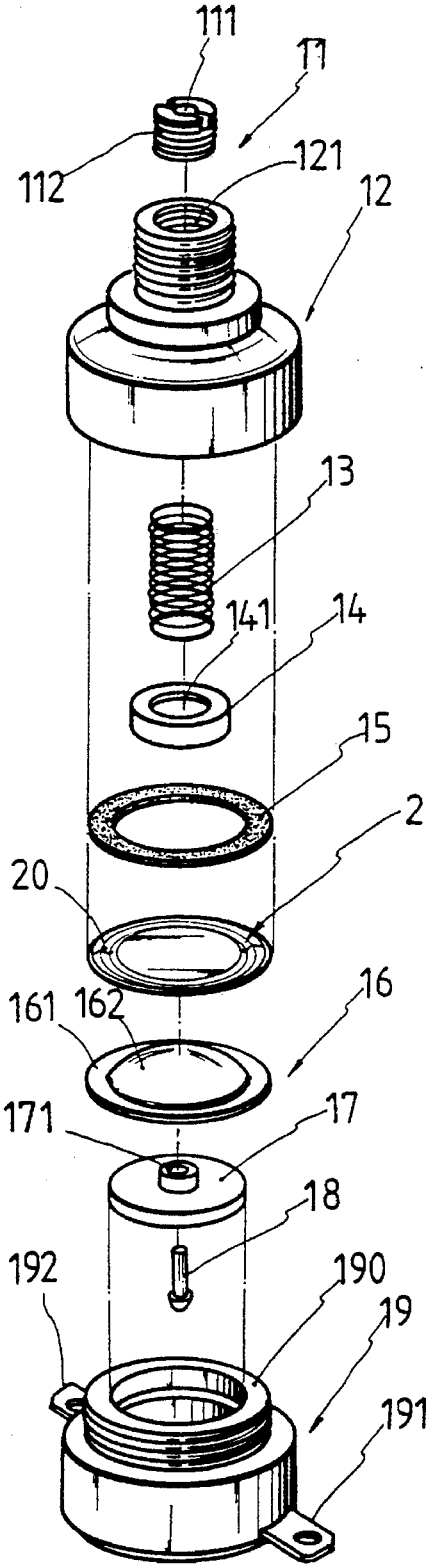
FIG. 3 is an exploded view of the present invention.
Figure 4:
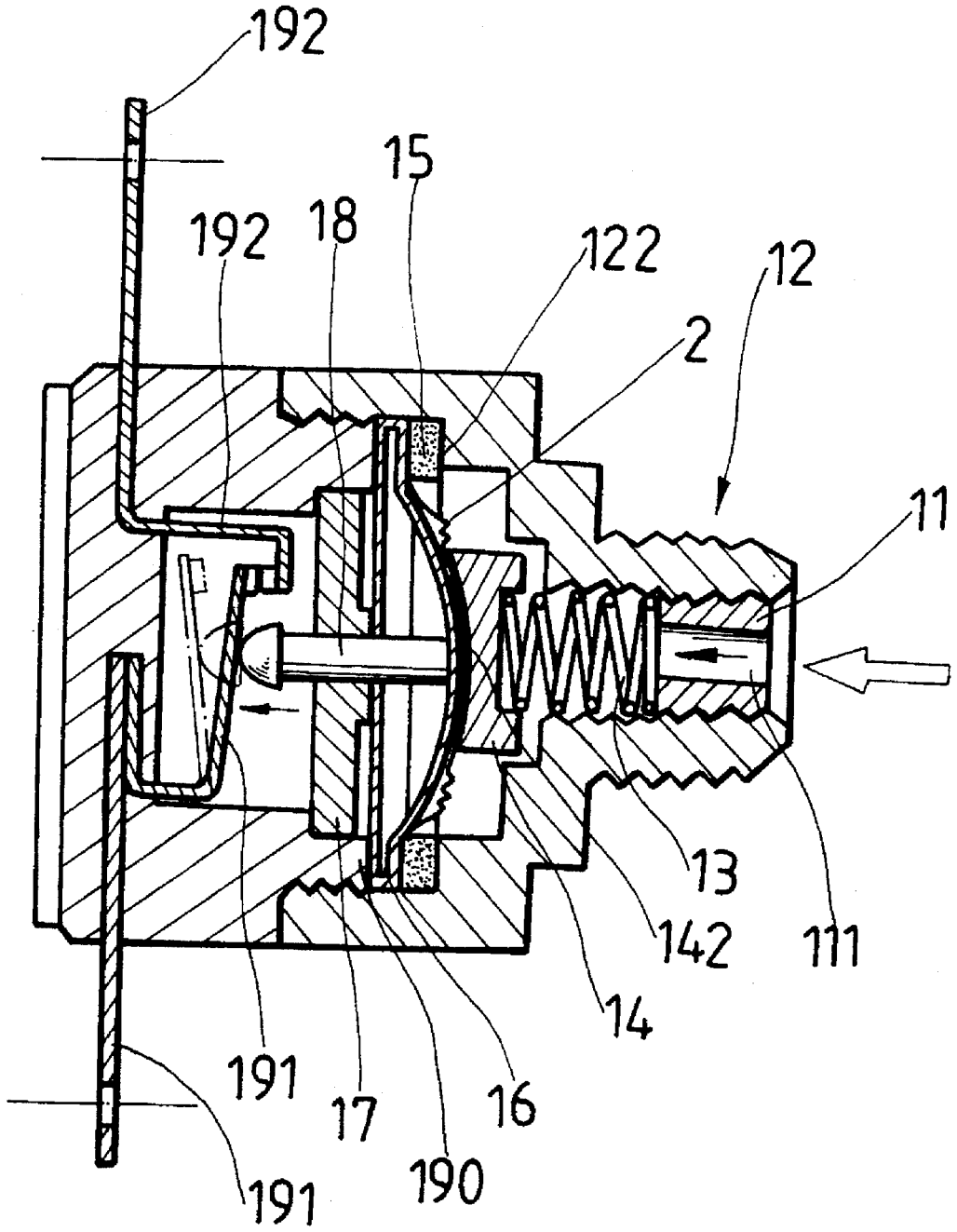
FIG. 4 is a sectional view of the present invention.
Figure 5:
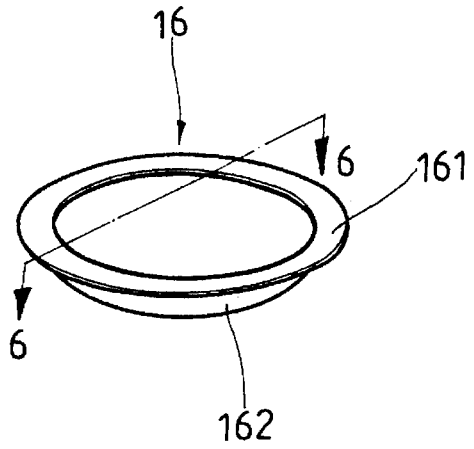
FIG. 5 is a perspective view of the resilient disc.

The control disc 2 is fitted under the plug 14 and the sealing ring 15 (with respect to FIG. 3). The control disc 2 has a wrinkled portion at the circumference so that the central portion thereof can be moved forward and backward.

The resilient disc 16 is disposed within the cover 12 and located under the control disc 2 (with respect to FIG. 3). The resilient disc 16 includes an annular portion 161 on which is fitted a diaphragm 162.

The circular plate 17 is installed in the base 19 and has a center hole 171.

The base 19 is provided with a first conducting member 191 and a second conducting member 192. The first conducting member 191 is a resilient member which is normally in contact with the second conducting member 192.

The pin 18 is inserted through the center hole 171 of the circular plate 17, with its one end bearing against the diaphragm 162 of the resilient member 16 and its other end against the first conducting member 191.

Figure 6:
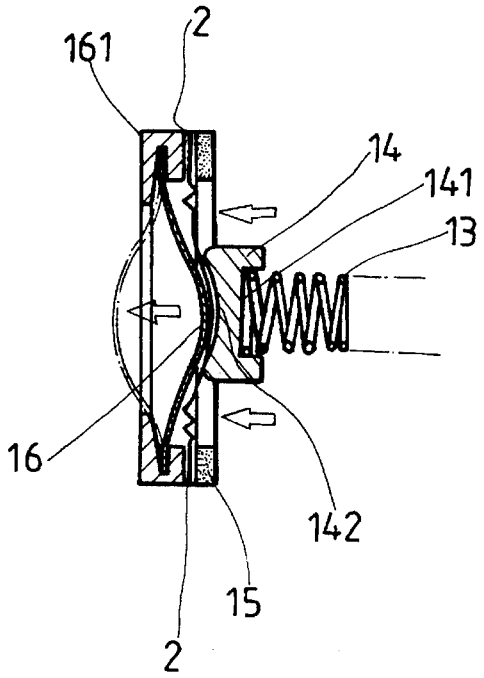
FIG. 6 shows the working principle of the present invention.
Figure 7:
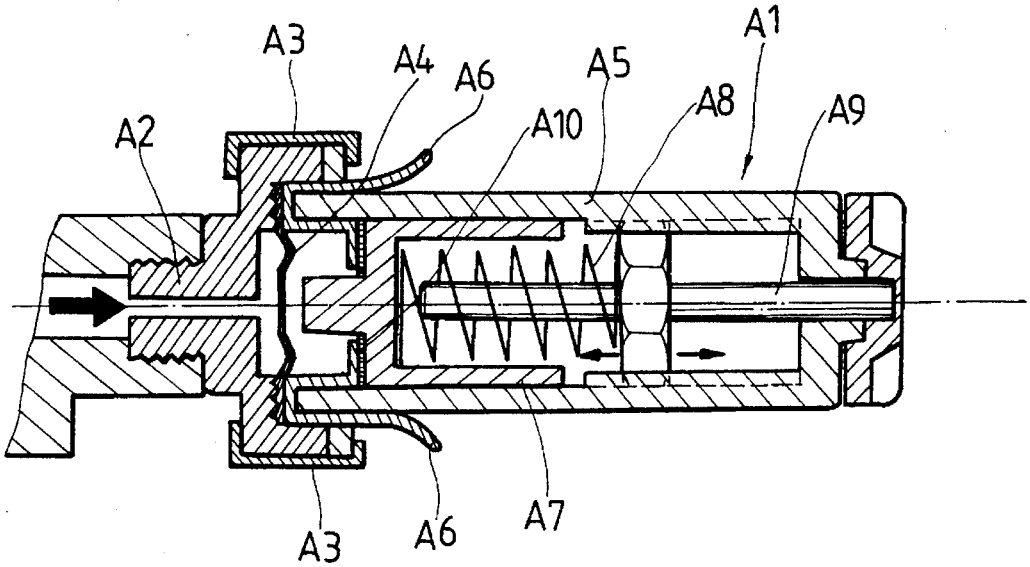
PRIOR ART FIG. 7
FIGS. 7 and 8 are sectional views of a prior art power breaker for a compressor for automobiles.
Figure 8:
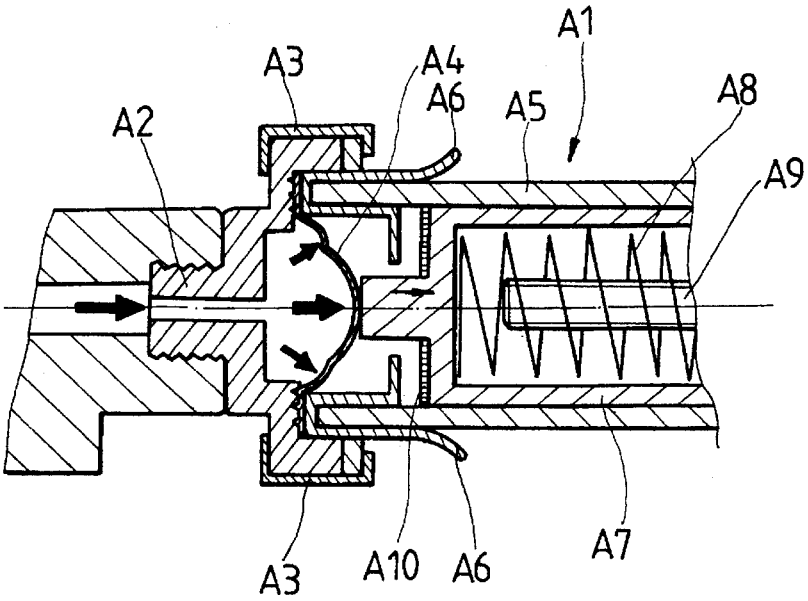
PRIOR ART FIG. 8

As the pressure applied on the power breaker according to the present invention exceeds the predetermined value, the central portion of the control disc 20 will move to the right (with respect to FIG. 6) which will in turn urge the diaphragm 16 of the resilient member 16 to push the pin 18 thereby forcing the first conducting member 191 away from the second conducting member 192 and therefore interrupting the flow of an electric current through the first conducting member 191 and the second conducting member 192 of the base 19.

It should be noted, however, that the predetermined pressure can be set by regulating the adjusting screw 11 and replacing the control disc 2 and the resilient disc 16 with ones with different thickness.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A power breaker for a compressor for automobiles comprising:

a motor driven compressor fluidly connected to a power breaker, said power breaker comprising:

a base provided with a first conducting member and a second conducting member, said first conducting member being a resilient member normally in contact with said second conducting member, said first conducting member and said second conducting member being designed to connect with a power supply;

a circular plate disposed within said base and having a center hole;

a resilient disc disposed on said circular plate, said resilient disc including an annular portion on which is fitted a diaphragm;

a pin inserted through the center hole of said circular plate and having one end bearing against the diaphragm of said resilient disc and another end against said first conducting member;

a control disc arranged on said resilient disc and having a wrinkled portion at a circumference thereof;

the resilient disk and wrinkled portion comprising a means for permitting a central portion of the resilient disk to be moved between a first position and a second position;

a sealing ring disposed on said control disc;

a plug formed from a solid member with a cavity at one end and a curved recess at another end, the curved recess of said plug being in contact with said control disc;

a spring mounted in the cavity of said plug;

a cover engaged with a top of said base and having a threaded hole; and an adjusting screw threaded engaged with the threaded hole of said cover;

said adjusting screw comprising a means for allowing adjustment of a force required to break contact between the first and second conducting members; actuating means providing a force for switching between a first position and a second position such that when the fluid pressure exceeds a design pressure of the power breaker, the second position is achieved, the first position being where the first and second conducting members are in contact with each other, said first position further characterized by a surface of the control disk having a concavity matching a concavity of the curved recess of the plug; the second position being where the first conducting member is displaced from the second conducting member so as to break electrical contact with the power supply, the second position further characterized by a surface of the control disk having a concavity opposite to the concavity of the first position.

* * * * *